United States Patent [19]

Konkel et al.

[11] 4,446,790

[45] May 8, 1984

[54] PRINTER WITH REMOVABLE PRINT CARRIAGE

[76] Inventors: Joseph Konkel; David F. Sweeney, both of 99 Middlesex St., Malden, Mass. 02148

[21] Appl. No.: 278,462

[22] Filed: Jun. 29, 1981

Related U.S. Application Data

[63] Continuation of Ser. No. 902,460, Apr. 20, 1978, abandoned.

[51] Int. Cl.[3] ..... B41J 1/20

[52] U.S. Cl. ..... 101/93.14; 101/111; 400/207

[58] Field of Search ..... 101/93.14, 111, 93.03; 400/207, 208, 209

[56] References Cited

U.S. PATENT DOCUMENTS

| | | | |
|---|---|---|---|
| 3,402,657 | 9/1968 | Potter et al. | 101/93.14 |
| 3,730,082 | 5/1973 | Perry | 101/93.14 |
| 3,747,521 | 9/1973 | Hamilton et al. | 101/93.14 |
| 3,805,697 | 4/1974 | Mahe | 101/93.14 X |
| 3,805,698 | 4/1974 | Bowers et al. | 101/93.14 X |
| 3,960,074 | 6/1976 | Chov | 101/93.14 |
| 3,981,235 | 9/1976 | Thomas et al. | 101/93.14 |
| 3,987,723 | 10/1976 | Mahoney et al. | 101/93.14 X |
| 4,002,118 | 1/1977 | Washimine | 101/93.14 |
| 4,196,666 | 4/1980 | Kobayashi et al. | 101/93.14 |

*Primary Examiner*—Edward M. Coven

[57] ABSTRACT

A compact data printer has a printing assembly cantilevered from a pedestal containing the power and control electronics. A tractor feed within the printing assembly draws the print medium (e.g. fan-folded paper) vertically from a supply stack and discharges it, after printing, at a location very near its entrance location to provide a compact print assembly. A print carriage containing a printing band, an anvil, a drive motor, and a ribbon cassette is quickly demountable by an operator from the main frame on which it rests to thereby facilitate maintenance or repair. A compact ribbon cassette minimizes storage volume when stored and protects the user against ribbon smudge during mounting on the print carriage.

8 Claims, 17 Drawing Figures

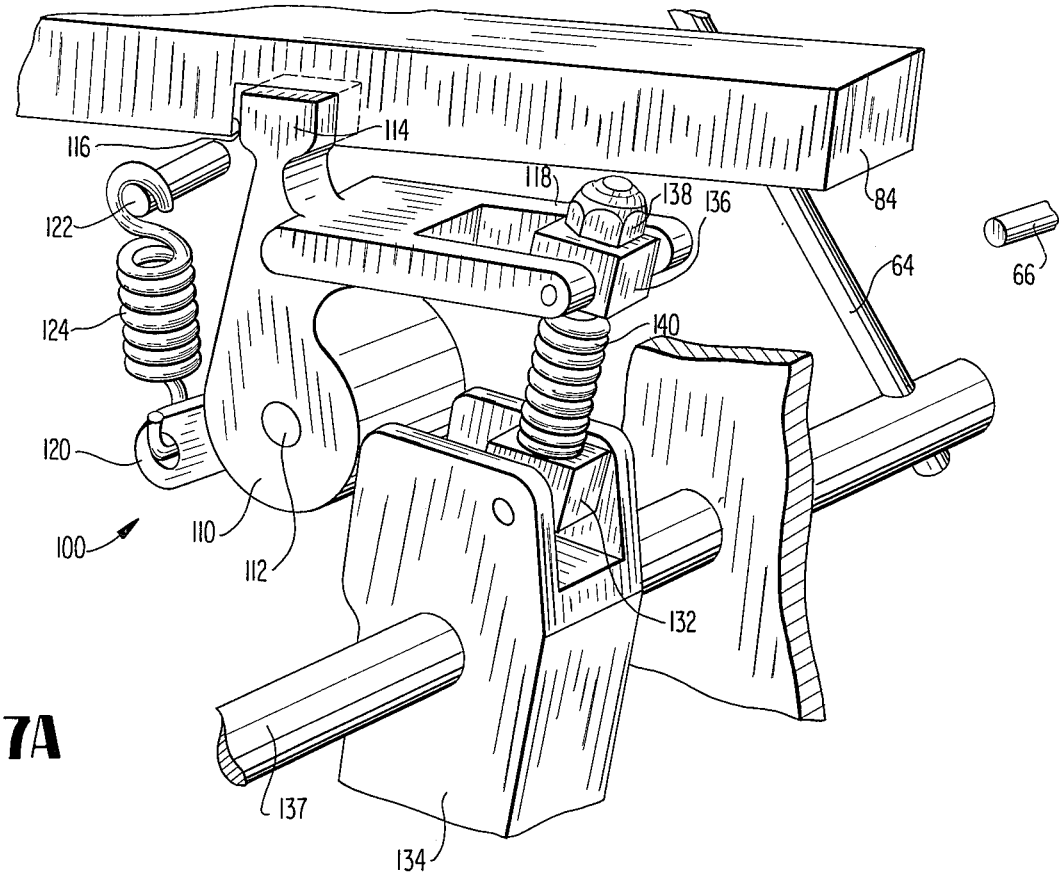
FIG 7A
FIG 7B
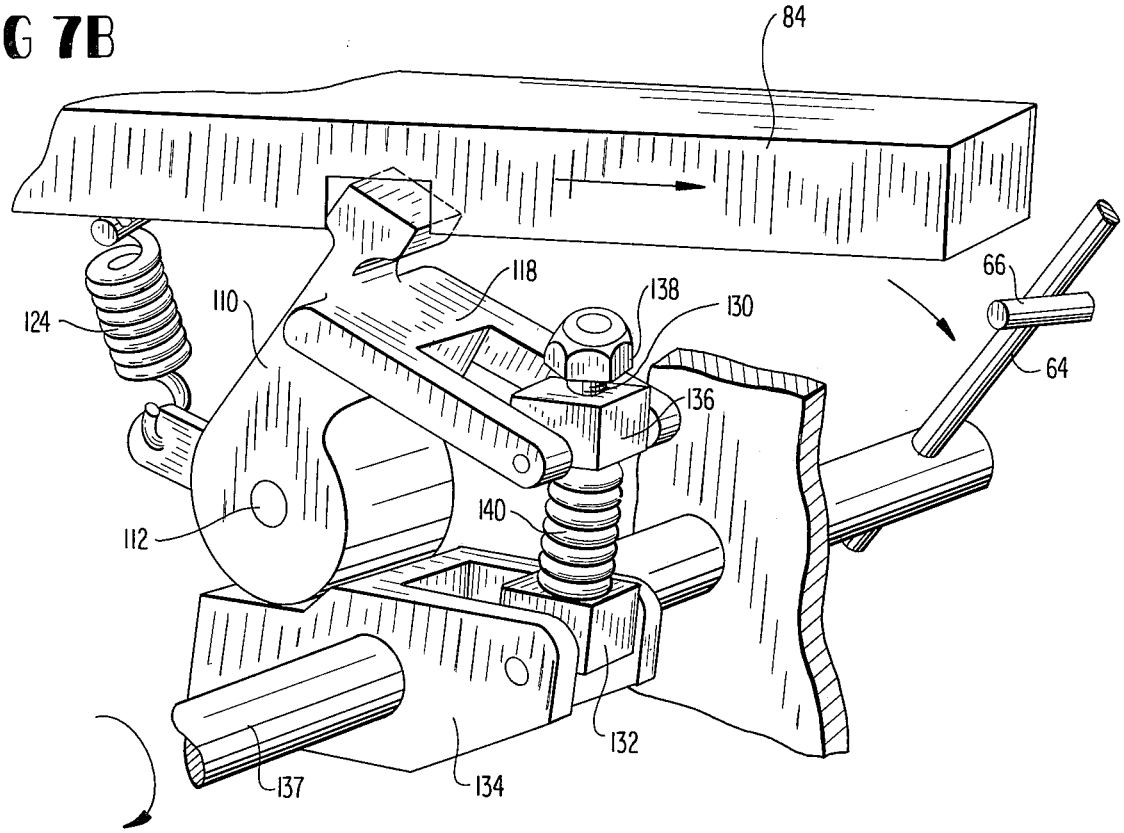

FIG 9A
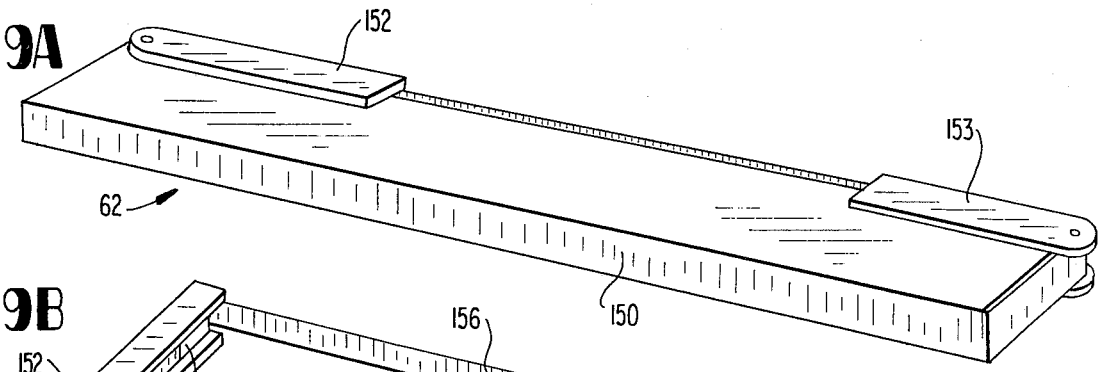
FIG 9B
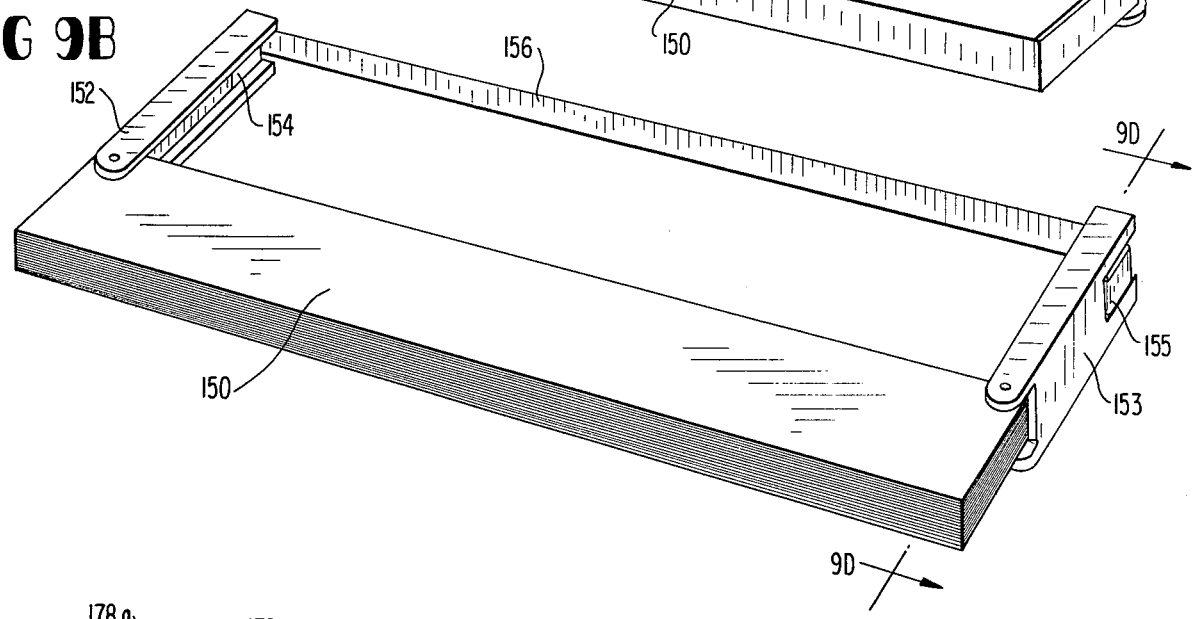
FIG 9D
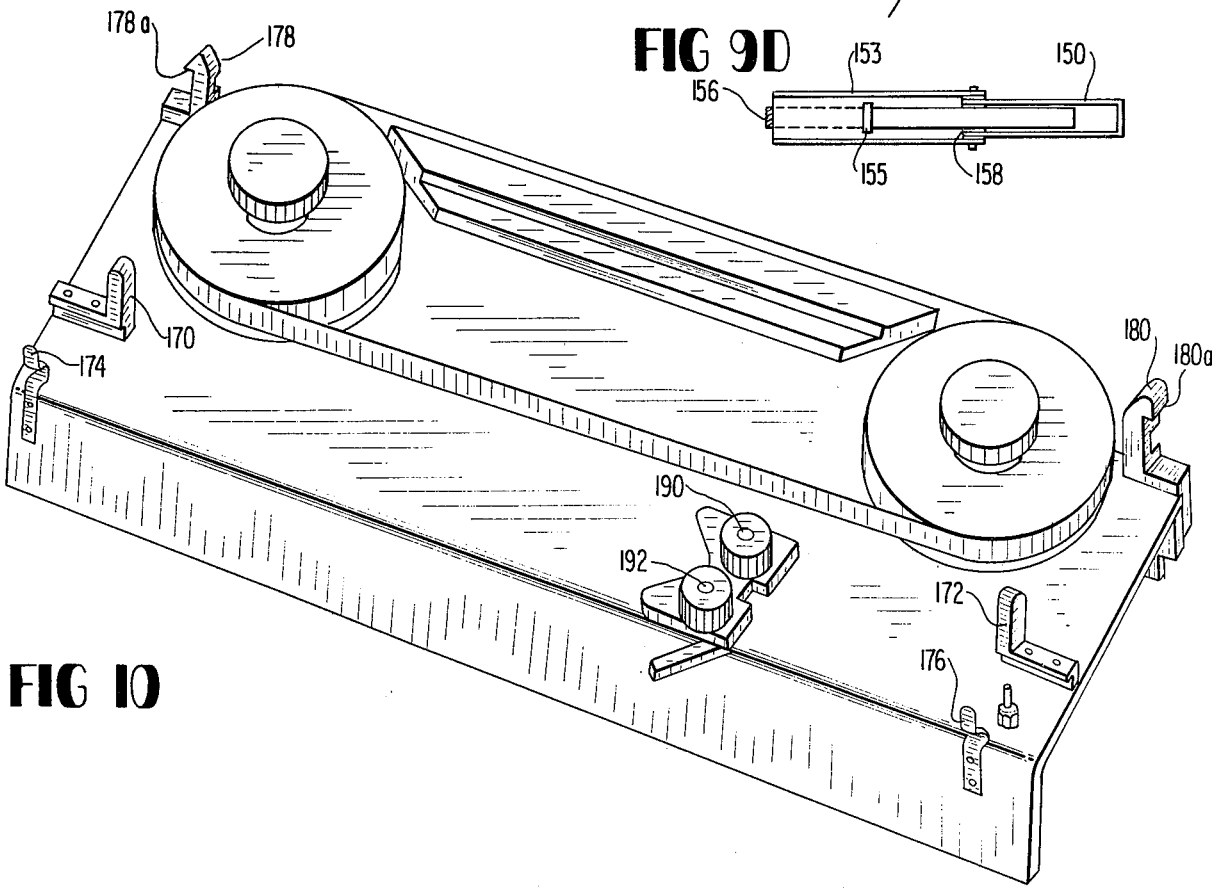
FIG 10

FIG 11A
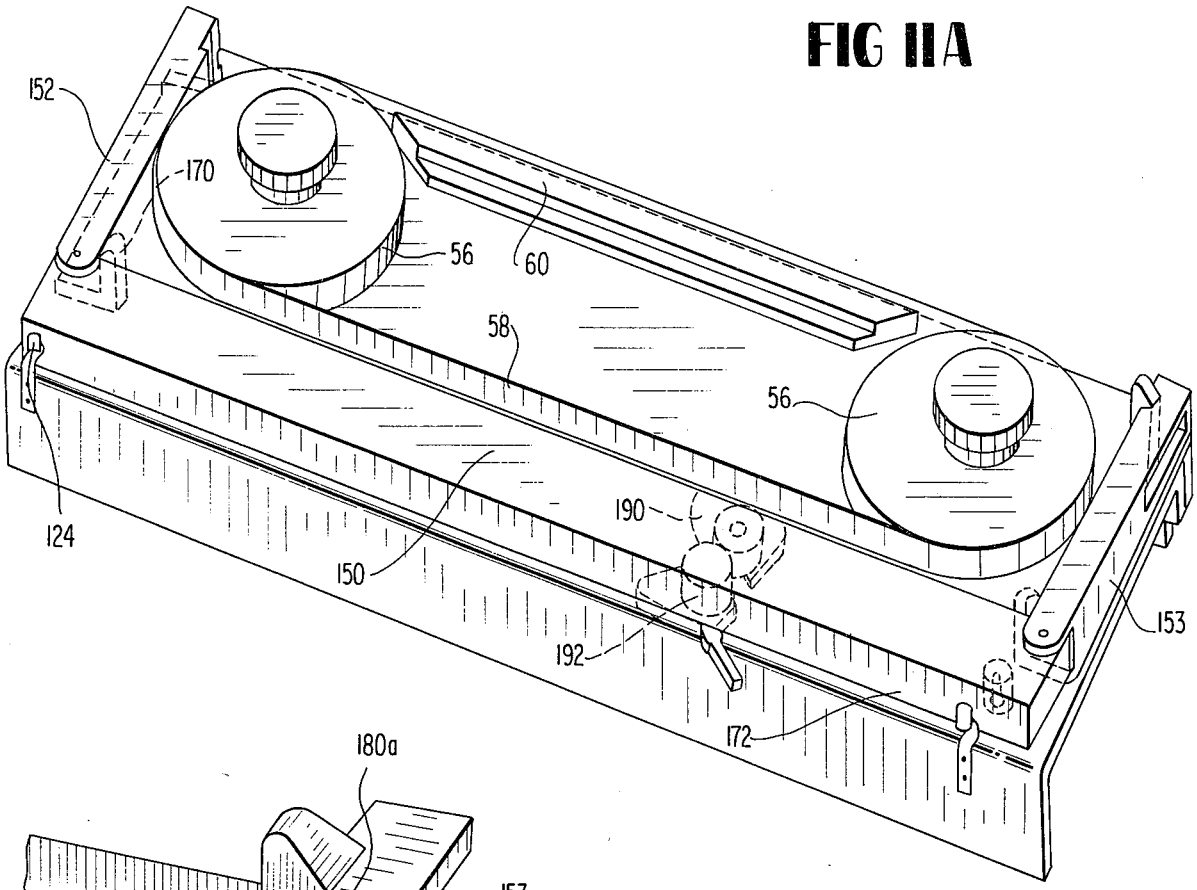
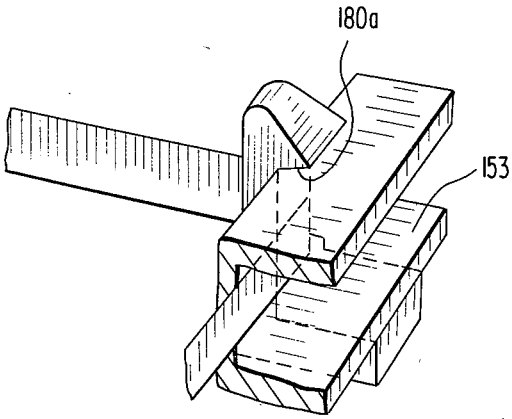
FIG 11B
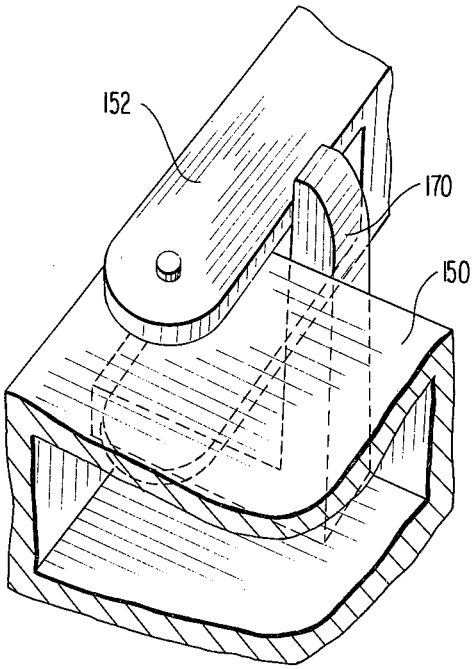
FIG 11C

PRINTER WITH REMOVABLE PRINT CARRIAGE

This is a continuation of application Ser. No. 902,460 filed Apr. 20, 1978, abandoned.

BACKGROUND OF THE INVENTION

A. Field of the Invention

The invention relates to data printers and, more particularly, to impact type data printers using print bands as the print elements.

B. Prior Art

Data printers print data on a record medium such as paper. Such printers are used extensively in the data processing industry to provide "hard-copy" output from computers and other equipment.

Impact type data printers forcibly strike a type font against a ribbon and then against the paper to imprint the individual characters comprising the data. Although these printers are capable of obtaining high print rates, they are typically large, bulky, complicated, and noisy. Thus, they are not generally suitable for placement in office environments and are typically isolated in a noise-shielded area. Further, these printers are also typically complex (and costly) therefore, and even routine maintenance can be quite time consuming. Additionally, their complexity can contribute to decreased reliability.

In printers, using ribbons as the character-forming element, the ribbon must be renewed periodically. Desirably, this is simple enough to be performed by the users of the equipment and not to require special maintenance personnel. Further, the ribbon change should be as simple as possible so that even inexperienced personnel can attend to it. In changing ribbons, however, direct contact with ink surfaces of the ribbon is often a problem, and ink smudges are often left on the operator, the machine, or the record medium during ribbon changing. The use of ribbon cassettes has been quite helpful in minimizing smudging problems, but has not altogether alleviated them. Additionally, many such cassettes are bulky and inconvenient to handle or store.

SUMMARY OF THE INVENTION

A. Objects of the Invention

Accordingly, it is an object of the invention to provide an improved impact printer.

Further, it is an object of the invention to provide a compact impact printer.

Another object of the invention is to provide an impact printer of simplified construction and suitable for use in an office environment.

Another object of the invention is to provide an impact printer which is accoustically relatively quiet given its compact size and slender profile.

Yet another object of the invention is to provide an impact printer which provides rapid and simple access to the printing and ribbon elements for ease of maintenance and repair.

Still another object of the invention is to provide an improved cassette for use in an impact printer.

B. Brief Description of the Invention

In accordance with the present invention, a compact printer of slender outline and relatively good accoustic characteristics for its size is formed by mounting a print assembly structure containing all the printing and print drive elements within an accoustically-isolating shell on top of a pedestal containing entirely immobile components, i.e., a power supply and the control electronics for the printer. The rear portion of the shell is cantilevered outwardly of the pedestal. Interconnection between the electronics and the print assembly within the shell is made via a single multi-wired cable. Access to the electronics is quickly had via a demountable front panel. Since it contains no moving components, the pedestal need not be accoustically insulated. Thus, it has a slender profile with a depth narrower than its width, and this minimizes the space it occupies.

The print assembly within the shell is divided into two major sub-assemblies, namely, the main frame, and the print carriage. Mounted on the main frame are the tractors (driving rollers) and associated driving motors and gears, together with print adjustment elements and elements helping to define the path of the record medium (hereinafter referred to simply as the "paper") as it passes through the print assembly. Entrance and exit apertures are formed in the shell for the purpose of admitting and discharging the paper on which the data is being printed. These apertures are located on the rearward cantilevered portion of the print assembly so that the paper entrance and exit occurs on the rear face of the printer. This minimizes the printer noise experienced by the operator of user at the front of the printer, and it comprises a desirable advantage of the printer of the invention.

The tractor wheels, comprising cylindrical wheels having conventional spiked fingers distributed around the periphery thereof to grasp corresponding holes on the edges of the paper, are located above the entrance aperture and slightly to the rear thereof so that the surfaces on which the paper rides are tangential to a vertical plane through the entrance aperture. Thus, the paper feeds into the print assembly in a completely vertical direction. Paper guides located on the inner face of the upper portion of the shell conform the paper to the tractor wheels over a path that is substantially greater than 90 degrees and, preferably, is of the order of 135 degrees. This minimizes the horizontal travel of the paper through the print assembly since it passes the paper to exit only a short distance from its entrance aperture. This results in a highly compact printer. Further, it maintains a larger number of teeth in contact with the paper than would be the case with shorter angular pathways, and this minimizes the tearing forces on the paper feed holes.

The print carriage carries the print band, the print band drive wheels, and their associated drive motors and gears; an anvil against which the print band and paper are struck during printing by hammers mounted on the main frame; and a ribbon cassette which supplies an endless loop of inked ribbon for forming the desired characters in conjunction with the print band, anvil, print hammers, and paper. The carriage is demountably attached to the main frame by means of latches on the main frame which engage the carriage, and is released on rotation of a latch release lever on the frame. In its normal or print position, the carriage is securely locked to the main frame in its forwardmost position, with the anvil located just rearwardly of the paper entrance aperture to provide a slight amount of clearance between the paper feeding through this aperture and the ribbon and print band which are mounted on the forward face of the anvil facing the paper. When a character is to be imprinted on the paper, a selected hammer on the main frame pushes the paper against the ribbon and the print band simultaneously, the anvil providing a backing surface for the print blow.

A three-point mounting suspension is provided for the print carriage. First and second mounting points are provided in the form of elongated pins extending forwardly from the carriage and mating with corresponding elongated apertures in the main frame. The pins slide freely in these apertures up to the limits imposed by adjustable limit stops described later. A third mounting point is provided by means of a pair of fingers on the rear portion of the carriage which engage a shouldered pin projecting upwardly from the main frame beneath the carriage. The fingers are oriented such that they rest on the shoulder and fork around the pin when the carriage is secured to the main frame, but slide off the shoulder when the carriage is moved rearwardly during removal from the main frame.

Cooperating with the mounting fingers on the print carriage is a print density adjustment mechanism on the main frame. This mechanism comprises a pair of threaded rods in the main frame extending forwardly into the apertures which receive the carriage pins and which butt up against the end faces of these or pins when the carriage is fully secured to the frame. The carriage is urged against these screws by a spring forming part of the latch mechanism. Thus, the position of these pins positively defines the spacing between the print hammers and paper path, on the one hand, and the print defining elements of the carriage, on the other hand. By rotating the threaded rods, the position of the carriage pins, and thus, the density of the imprinted characters, can be changed. This adjustment is accomplished by means of collars firmly secured to the respective rods; a coupling bar extending transversely across the frame from one collar to the other and pivotally secured to the respective collars to ensure identical motion of the rods; and a crank arrangement coupled to one of the collars to cause selected rotation thereof and thereby "fine-tune" the position of the threaded rods to adjust the print density.

The latch mechanism allows the carriage to be moved backwardly from the print hammers and paper path either a slight distance for normal maintenance operations such as print band replacement or ribbon cassette replacement, or a larger distance for complete removal of the carriage from the main frame for extended maintenance or repair operations. This is accomplished by a latching mechanism on the frame comprising a cam rotatably mounted on a first axis, a trunnion rotatably mounted on a second but adjacent axis, and a spring-enclosed connecting rod pivotally intercoupled between the trunnion and a yoke arm of the cam. In its fully secured position, with the carriage mounted in its forwardmost operating position adjacent the paper, the axis of the connecting rod, and thus of the spring mounted on it, is located on one side of the trunnion axis. This applies a torque to the cam which causes a head of the cam to pivot forwardly; this head engages an aperture in the carriage frame and accordingly biases the frame forwardly toward the print hammers. A latch release arm attached to the trunnion is operable by the user to rotate the trunnion and reorient the connecting-rod axis to the opposite side of the trunnion axis; this rotates the cam head rearwardly and the print carriage accordingly moves rearwardly also. At the same time, a bearing surface on the trunnion is brought into contact with the cam to prevent return of the cam to its original position until the operator restores the trunnion to its original position.

A spring-loaded pin on the main frame limits rotation of the latch release arm to this first position. However, when it is desired to fully remove the carriage from the main frame, the user may depress the spring-loaded pin, thereby allowing the latch arm to be fully rotated. When this is accomplished, the head on the cam drops out of the slot in the carriage and allows the carriage to be moved sufficiently rearwardly to disengage its front mounting pins from the main frame and thereby free the carriage.

DETAILED DESCRIPTION OF THE INVENTION

A fuller understanding of the objects, features and advantages of the invention will be more readily understood on reference to the following detailed description of the invention when taken in conjunction with the accompanying drawings in which:

FIG. 7 is a view in perspective showing the latch mechanism in its closed (FIG. 7A) and partially open (FIG. 7B) positions;

FIGS. 9A and 9B are views in perspective showing the ribbon cassette of the present invention with its arms closed (FIG. 9A) and fully opened (FIG. 9B); FIG. 9D is a fragmentary vertical sectional view along the lines 9D—9D of FIG. 9B showing details of the ribbon exit aperture in the cassette;

FIGS. 10 and 11 are views in perspective of the print carriage showing in greater detail the manner in which the cassette is mounted on the carriage (FIG. 11A), as well as details of the mounting (FIGS. 11B and 11C);

Figure 2:
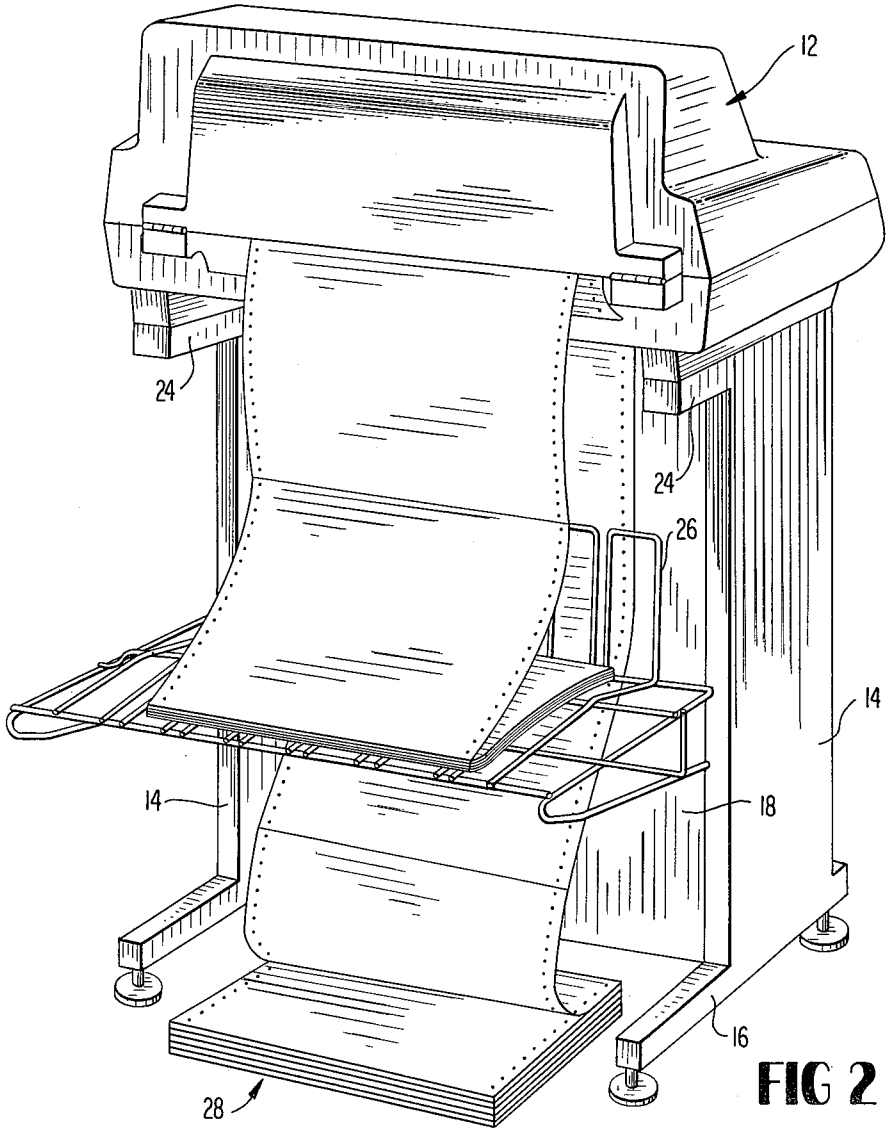
FIG. 2 is a rear view in perspective of the printer of FIG. 1.
Figure 1:
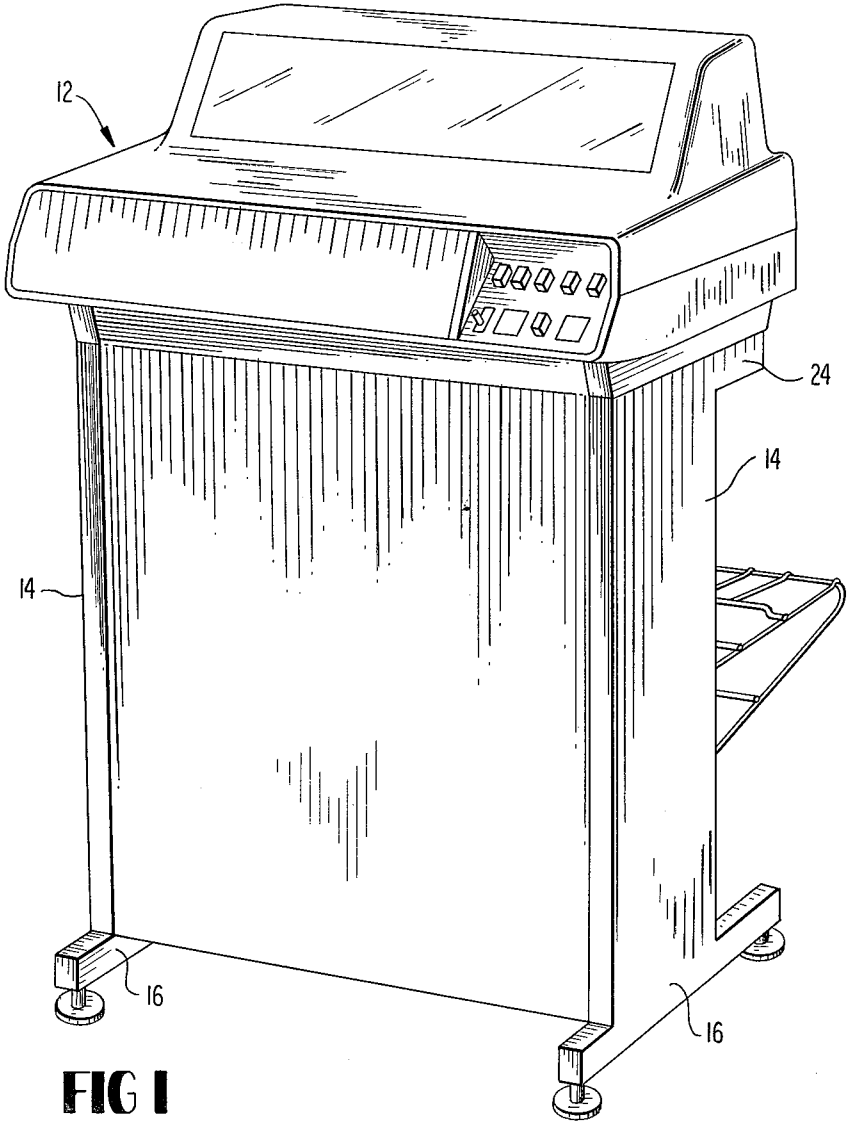
FIG. 1 is a front view in perspective of a printer constructed in accordance with the present invention.

In FIGS. 1 and 2, the printer of the present invention comprises a pedestal 10 on which is mounted a case 12. The pedestal comprises a generally rectangular body formed by side panels 14, front panel 16, and rear panel 18. Feet extensions 20 and feet 22 provide support for the body. Upper arms 24 extend rearwardly of the side panels 14 and support the rear portion of the case 10 in cantilever fashion on the pedestal. A wire platform 26 is attached to the rear edges of side faces 14 and expands across the side faces. Panel 18 is recessed inwardly from the rear edges of the side faces 14 and a supply of paper 28 feeds upwardly behind the platform 26 and in front of the panel 18 into the case 12 (see FIGS. 12 and 13 for further detail). The paper exits, after printing, from the rear of the case 12 and is folded onto the platform 26.

Figure 3:
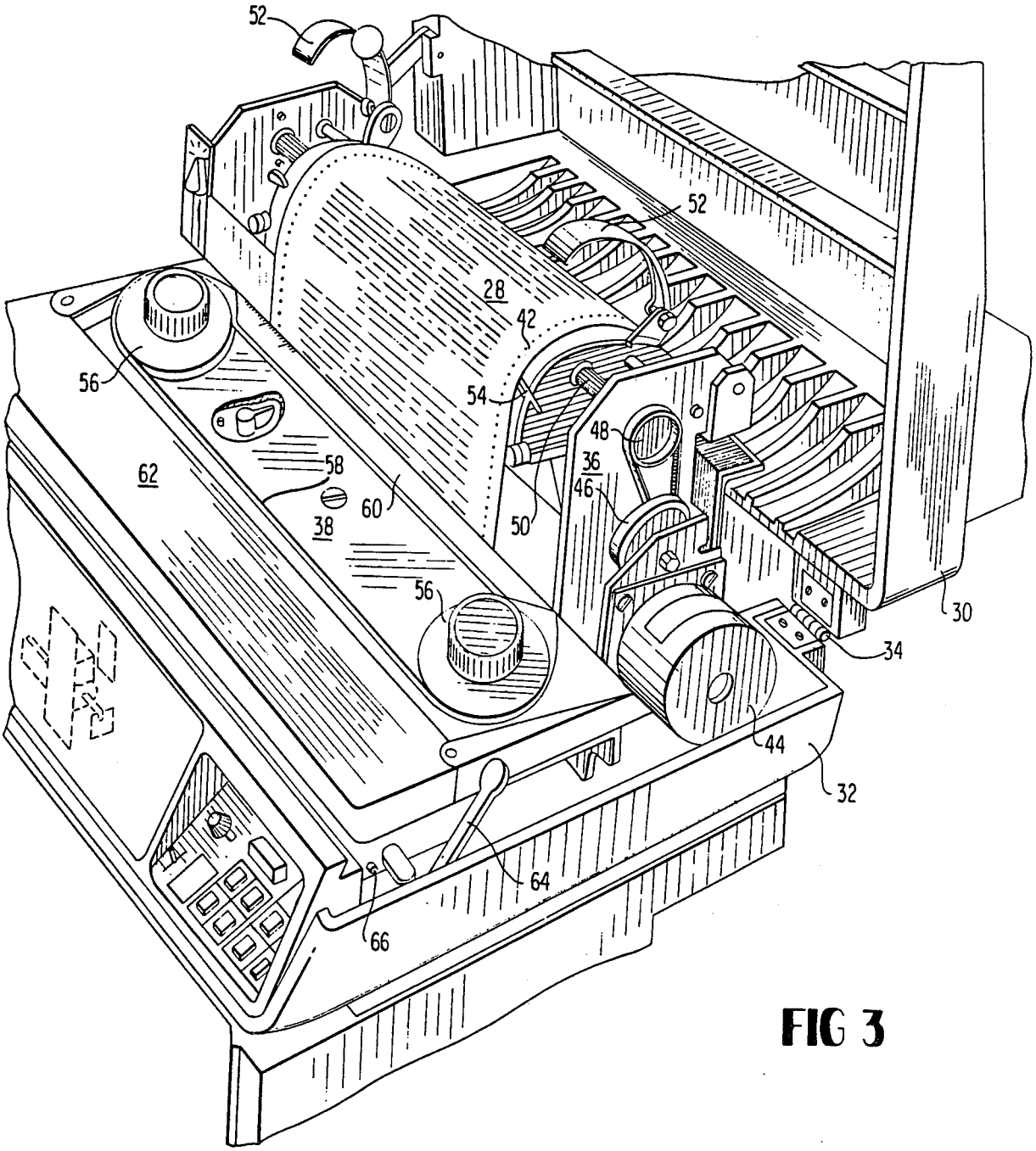
FIG. 3 is a view in perspective of the printer of FIG. 1 with the shell raised to show the print assembly structure within it.

Referring now to FIG. 3 the case 12 is formed from an upper cover 30 and a lower base 32 connected by hinges 34. The print assembly mechanism is contained in the base 32 and comprises a main frame 36 and a print carriage 38 mounted on it. Rotatably mounted on the main frame 36 are tractor wheels 40 (FIG. 5) having fingers 42 spaced around the periphery thereof to engage corresponding holes in the paper being fed through the print assembly. The wheels are driven from a motor 44 through reduction gearing 46, 48 and shaft 50. Spring loaded clamps 52 overlie the tractor wheels and are locked into positioned by pivoted, spring loaded arms 54 attached to the main frame. Hammer arms 55 actuated from a hammer actuator 57 are vertically and horizontally aligned with the anvil of print carriage 38.

Print carriage 38 is detachably mounted on main frame 36 and carries a pair of print band pulleys 56, a print band 58, an anvil 60, and a ribbon cassette 62. A latch release arm 64 allows the operator to move the print carriage 38 rearwardly away from the path of paper 28 by moving the latch release arm 64 back to the position defined by a spring loaded pin 66 which acts as a stop for the arm 64 or even to remove the carriage completely from the main frame by depressing the spring loaded pin and rotating the arm beyond the point defined by this pin. This will be described in more detail subsequently.

Figure 6:
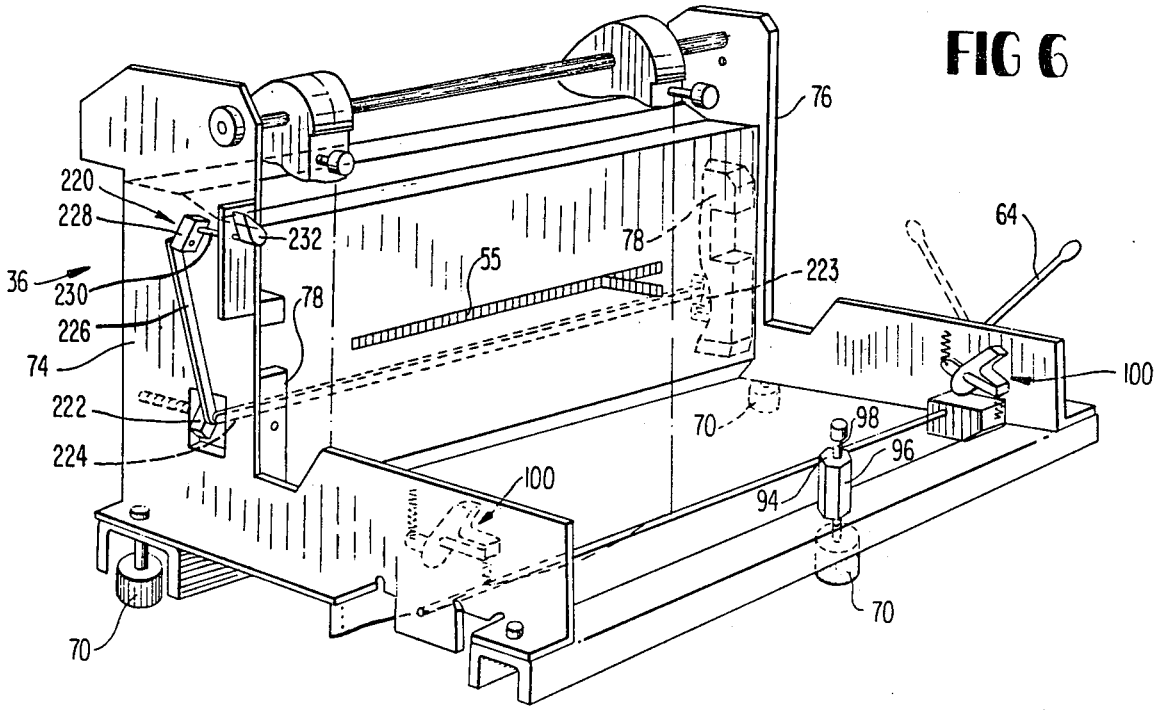
FIG. 6 is a simplified view in perspective showing the main frame assembly and the print adjustment control.
Figure 4:
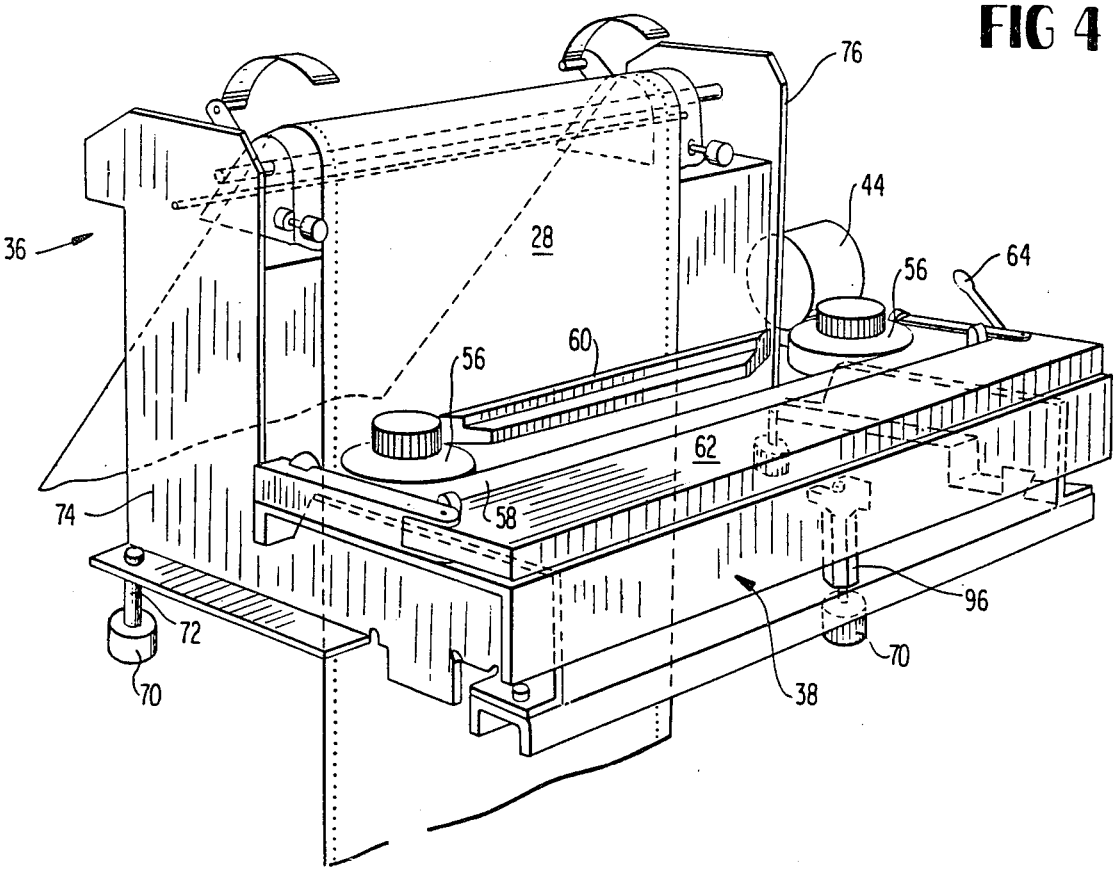
FIG. 4 is a simplified view in perspective of portions of the print assembly and carriage structure showing the positional relationship between them more clearly.
Figure 5:
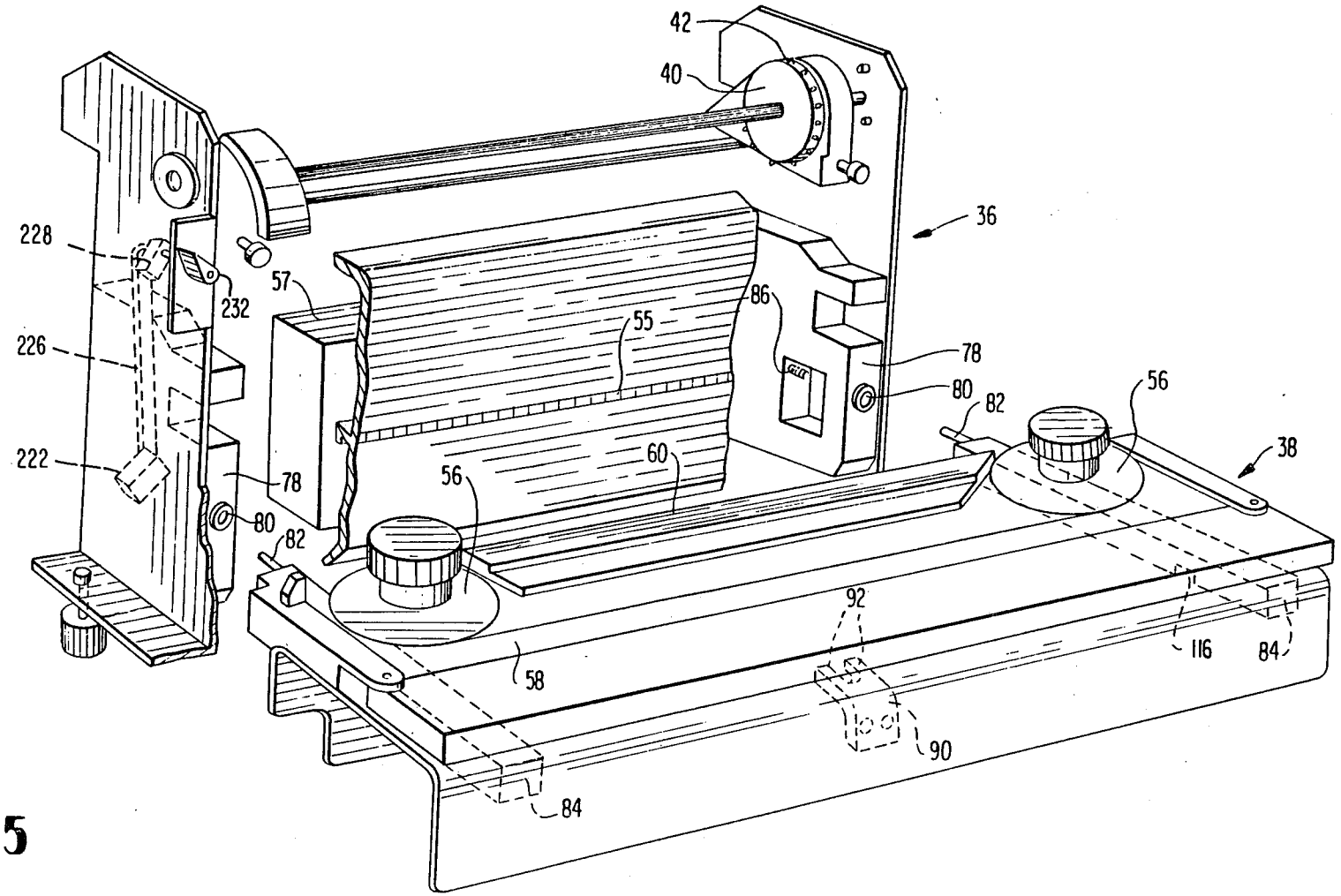
FIG. 5 is a simplified view in perspective showing the print carriage removed from the main frame assembly.

Referring now to FIGS. 4 through 6, the main frame 36 and print carriage 38 are shown in further detail. The main frame 36 is mounted on the lower case 32 (FIG. 3) by means of three level adjusters, each comprising a foot 70 of rubber, plastic or other vibration dampening material threadedly mounted on a finger 72 and providing a three-point suspension for the main frame. The main frame 36 includes side walls 74, 76 carrying stiffening yokes 78 having horizontally and rearwardly extending apertures 80 formed therein. Pins 82 extending forwardly from reinforcing rods 84 on carriage 36 (FIG. 5) mate with the apertures 80 and, when the carriage is tightly locked to the main frame, extend through the apertures and press against threaded rods 86. These rods define the rearmost limit of travel of the carriage 38 with respect to the main frame 36.

The printer also includes an arrangement 220 by which the operator can easily move the threaded rods forward or rearward, thereby changing the rearward limit of travel of the carriage. Each threaded rod 86 is tipped with a collar 222 and 223. A linkage rod 224 is rotatably secured between the collar 222 and 223. The linkage rod 224 and one collar are also pivotally connected to a second linkage 226 that extends upwardly to a third collar 228 attached to a pin 220 which in turn ends in a user-operable knob 232. As the knob is turned, the pin 230 rotates the collar 228, which raises or lowers linkage 226. This in turn rotates collar 222 and its rod 86. Linkage 224, in turn, rotates collar 223, which rotates its rod 86, keeping the rods in alignment.

The pins 82 provide two of the suspension points of the carriage 38 with respect to the frame 36. The third suspension point is provided by means of a bracket 90 mounted on the underside of the carriage 38 and having fingers 92 spaced from the under surface of the carriage and resting, when the carriage is secured to the main frame, on a shoulder 94 of a post 96 (FIG. 6). Post 96 has a pin 98 extending upwardly therefrom for engagement with the fingers 92. The carriage 38 is thus stably mounted on the frame 36.

Figure 8:
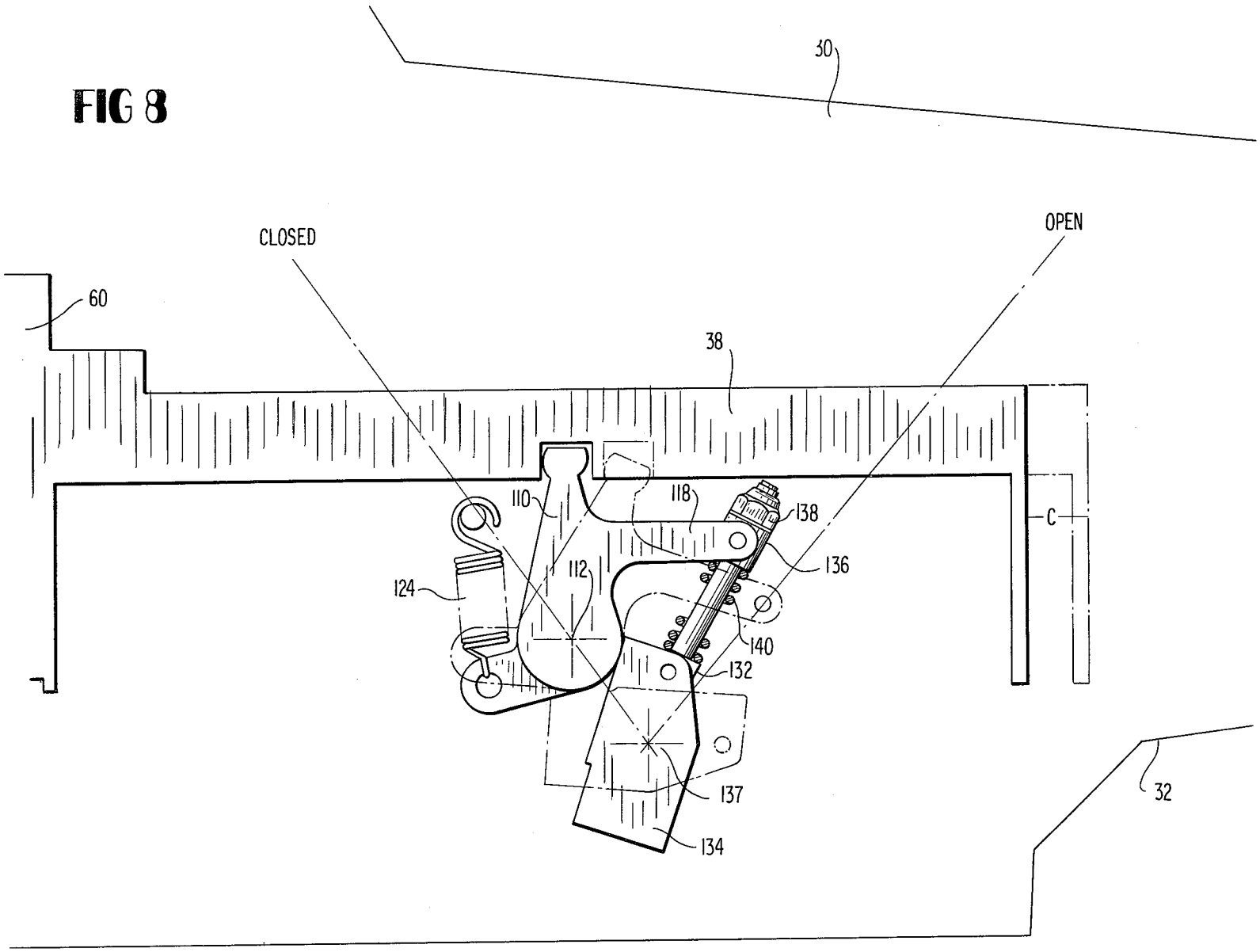
FIG. 8 is a simplified vertical sectional view showing the latch mechanism in its closed (full line) and partially open (chain line) positions.

Carriage 38 is locked to frame 36 by a latching mechanism 100 which is illustrated in greater detail in FIGS. 7 and 8. The latching mechanism comprises a cam 110 rotatably mounted on a bearing 112 connected to the main frame 36 and having a head 114 and a yoke 118 extending therefrom, as well as an arm 120 connected to a rod 122 on frame 36 by means of a spring 124. The head 114 engages a latch 116 in stiffening rod 84 when the carriage is secured to the frame. A connecting rod 130 is fixedly connected to a lower block 132 which is pivotally mounted in a trunnion 134 and rides freely through an apertured upper block 136 which is pivotally mounted in yoke 118. Trunnion 134 is rotatably mounted on the frame 36 by means of its shaft which spans the frame and connects to a corresponding trunnion forming part of a similar latching mechanism on the opposite wall of the frame. A nut 138 is threadedly mounted on the upper end of the rod 130 and defines the outermost limit of movement of block 136 with respect to block 132. A helical compression spring 140 is mounted concentric with rod 130 between blocks 132 and 136. The spring 114 provides substantially greater spring force than spring 124.

When the carriage is firmly secured to the frame, in its forwardmost position, arm 64 is in its forwardmost position. In this position, which is shown in FIG. 7A and in solid lines in FIG. 8, the axis of the rod 130, and thus of the spring 140, is located forwardly of the shaft 137. Spring 140 pushes blocks 132 and 136 apart and this holds trunnion 134 in its most counterclockwise position as seen in solid lines in FIG. 8. At the same time, this forces the yoke 118 of cam 110 to its most counterclockwise position, and head 114 presses against the forward face of aperture 116 to urge the carriage 38 to its forwardmost position (shown in solid lines in FIG. 8) in which it positions the anvil, as well as the print band, and ribbon band closest the paper and the hammer arms. Spring 124 counteracts the force created by spring 140 to a certain extent, but the clockwise torque applied by the spring 124 is substantially less than the clockwise torque to the cam 110 by the spring 140.

When the operator moves the lever 64 rearwardly away from the paper to the position shown in FIGS. 7B, and in chain lines in FIG. 8, the rod 130 and spring 140 shift direction from one side of rod 137 to the other and thereby rotate trunnion 134 in a clockwise direction to the position shown in dotted lines in FIG. 8. At the same time, the cam 110 is rotated horizontally by means of both the connecting rod 130 and the spring 124 and it moves to the position shown in FIGS. 7B and in dotted lines in FIG. 8. In this position, the carriage 38 is moved rearwardly from its original position by the distance "C" in FIG. 8. This is sufficient to provide access to the print band and ribbon to make any needed adjustments and changes. However, it is insufficient to remove the pins 82 from the apertures 80 or the fingers 92 from the shoulder 94. Thus, in this position, the carriage still remains mounted on the frame.

When it is desired to remove the carriage from the frame entirely, spring loaded pin 66 (FIGS. 3 and 7) must be depressed by the operator to allow the latch arm 64 to be rotated further rearwardly (clockwise in FIG. 8) than just described. When this is done, further rotation of trunnion 134 causes rotation of cam 110 sufficient to drop the head 114 from the aperture 116, thereby allowing the carriage 38 to be moved sufficiently rearwardly (backwardly from the paper) as to free pins 82 from apertures 80 and fingers 92 from pin 98

(FIGS. 5 and 6). After detaching the appropriate electrical connectors (not shown), the carriage may then be completely removed from the printer.

Referring now to FIGS. 9 through 11, the cassette 62 will be described in more detail. The cassette comprises a rectangular housing 150 having pivoted arms 152, 153 at corresponding edges thereof. These arms comprise generally U-shaped channels, each having an aperture 154 at the outer ends thereof. A ribbon 156 emerges from the housing 150 through an exit aperture 158, follows along the inside surface of arm 152 until it reaches aperture 154, passes through aperture 154 to the outside surface of arm 152, passes across to arm 153 on the outside face thereof, passes through aperture 155 to the inside of arm 153, and returns to the housing 150 through an entrance aperture corresponding to exit aperture 158.

During storage and prior to use, the arms 152 and 153 of cassette 162 are folded inwardly as shown in FIG. 9A. This minimizes storage volume and keeps the ribbon closely adjacent the housing 150 to minimize smudging. When it is to be used, the arms 152 and 153 are folded outwardly of the cassette to the position shown in FIG. 9B and the cassette is then mounted on the carriage. The user need not touch the ribbon itself in doing this and thus the possibility of smudges from the ribbon is minimized.

FIGS. 10 and 11 illustrate details of the cassette mounting. Positioning rods 170, 172 and spring clamps 174, 176 securely lock the housing 150 into position on the carriage 38 as shown in FIG. 11. The housing 150 butts against the side faces of the rods 170 and 172 and is spring-loaded against them by the clamps 174, 176. Positioning rods 178, 180 at the forward end of the carriage 38 limit inward pivoting of the arms 152, 153 when the tape is mounted as shown in FIG. 11. Additionally, the rods 178, 180 have overhanging lips 178*a*, 180*a*, respectively, and thus vertically orient the arms as well and lock them into a fixed position.

The cassette structure shown allows the operator to quickly mount a ribbon and demount the old ribbon without touching the exposed ribbon portions. Further, the arms themselves serve the function of the usual ribbon guide, and thus the wear caused by passage of the ribbon is limited to wear of the arm structures and the housing itself. Since these are periodically disposed of, cumulative wear is minimized.

FIGS. 10 and 11 show the tape driving structure used with the cassette. The tape driving structure comprises a pair of wheels 190, 192, one of which is moveable via means of a lever 194 to engage the ribbon in the nip between them when a cartridge is inserted on them. A locator pin 196 also is used in guiding tape movement within the cartridge. These elements are conventional and form no part of our invention; accordingly, they will not be described in further detail.

An important aspect of the present invention is the geometry of the paper flow path through the printer. This was discussed briefly earlier, and it was there noted that the geometry of the path made a significant contribution to the compactness of the printer. This will now be described in more detail.

Figure 12:
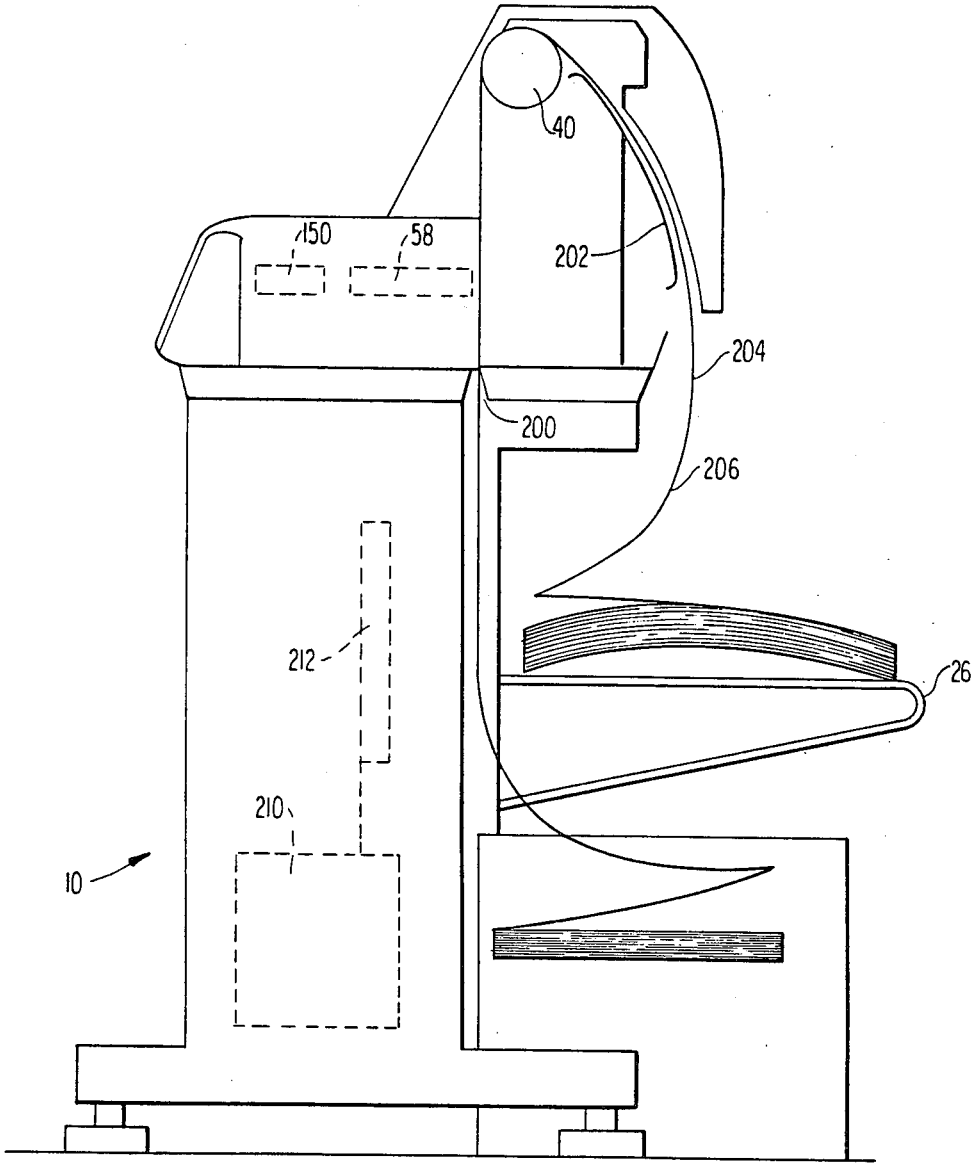
FIG. 12 is a simplied, schematic vertical side sectional view of the printer of FIG. 1 showing the path of paper through the print assembly.
Figure 13:
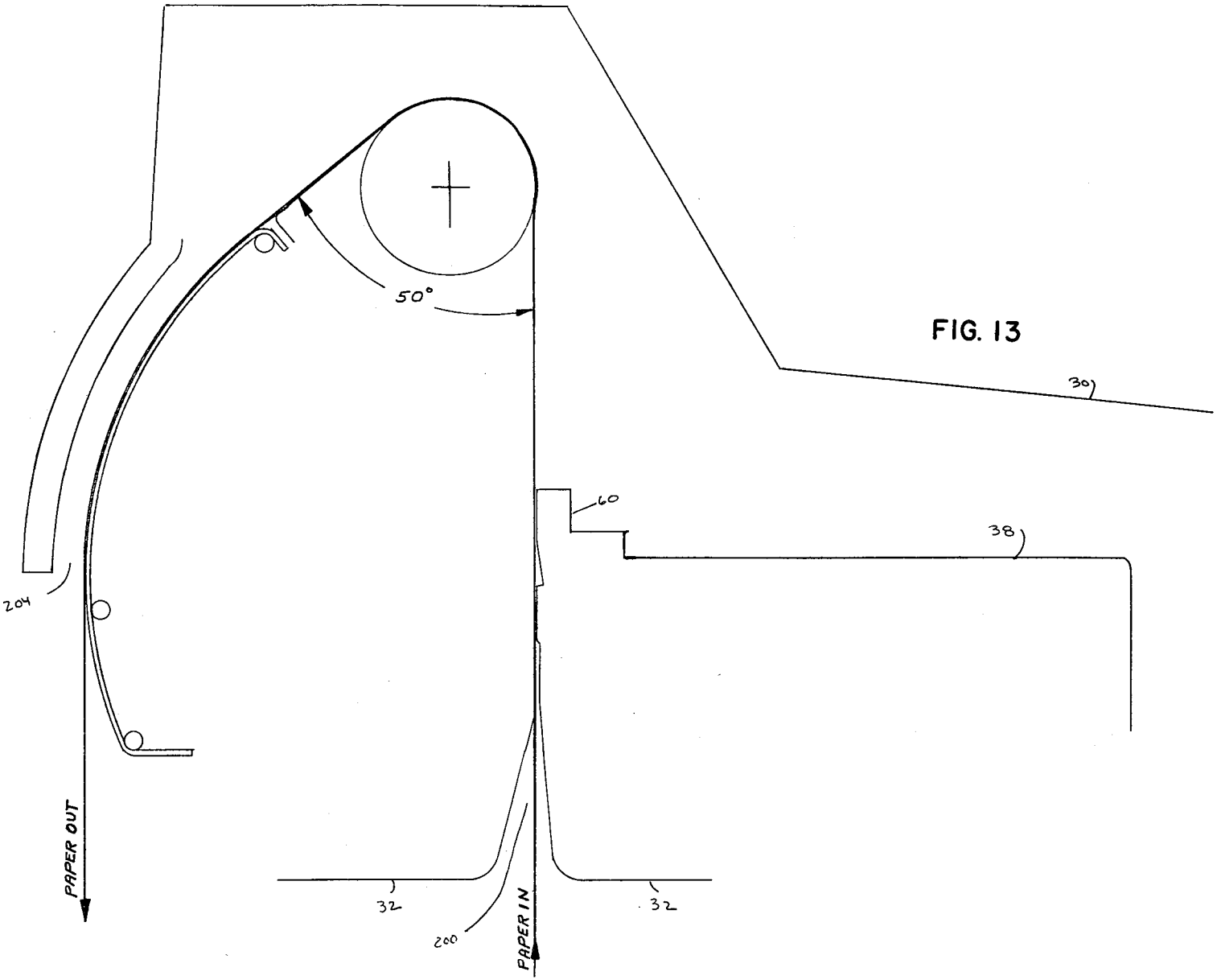
FIG. 13 is a simplified enlarged sectional view of a print assembly, showing the paper path through it.

Referring to FIGS. 12 and 13, an elongated narrow aperture 200 is formed through the lower base 32 of printer case 10 to admit paper into the print assembly. As was previously noted this aperture is positioned immediately adjacent, but behind, the carriage 38 so that the carriage lies in front of this aperture. The aperture 200 is vertically aligned with the outer periphery of the tractor wheels 40 so that the paper 200 forms a vertical path tangential to these wheels as it passes up into contact with them. Thereafter, the paper conforms to these wheels over a path that is of the order of 135 degrees in the preferred embodiment as shown in FIG. 11 and passes along a guide plate 202 toward and through an exit aperture 204 in the case 10. The exit aperture is located so that it is at, or near, the point of maximum rearward extension 206 of the paper, and the carrier 26 is positioned so that its mid-point lies directly under the point 206. Accordingly, the paper neatly folds on the carrier 26 as it emerges from the printer, and the transverse dimensions of the printer are held to a relatively small size.

As noted previously, the electronics, comprising a power supply 210 and a control panel 212, are mounted entirely on the pedestal 10. The front cover of the pedestal is removeable to provide rapid and convenient access for maintenance, testing and repair purposes without interference from the paper path.

From the foregoing it will be seen that we have provided a greatly simplified, compact, reliable printer. The printer section, which receives the greatest wear and needs the greatest maintenance and adjustments, is easily removed from the main frame to facilitate adjustment, maintenance or repair. An improved cassette used with the printing section allows rapid and accurate positioning of the print ribbon, while avoiding smudging of either the operator or the machine. Finally, a simplified paper flow path and paper positioning provide a marked reduction in overall size while maintaining an accoustic isolation characteristic of larger more complicated printers.

Having illustrated and described our invention we claim:

1. A band-type data printer comprising a main frame releasably supporting a print carriage, A. said main frame being cooperable with said print carriage for defining a path for passage of a recording medium therebetween and containing a plurality of actuable hammers mounted adjacent said path and cooperable with said print carriage to imprint information on the recording medium, and further including:

(1) carriage supporting means for supporting said print carriage, and (2) carriage latch means cooperable with said print carriage for releasably securing said print carriage to said frame, said carriage latch means comprising:

i. a cam pivotally mounted on said frame and having a head cooperable with a notch in said print carriage, ii. a trunnion pivotally mounted on said frame, iii. a connecting rod having first and second rod heads, means for preventing said rod heads from separating by more than a predetermined distance, and a spring coaxial with said connecting rod for urging said rod heads apart to tend to keep said rod heads separated by said predetermined distance, said first and second rod heads being pivotally connected to said cam and said trunnion, respectively, at pivot points thereon separated from said cam and trunnion axes, respectively, to tend to keep the pivot points separated by the predetermined distance so that said cam tends to rotate with rotation of said trunnion and there is a range of angular positions of said trunnion in which the axis of said connecting rod passes from one side of the trunnion axis through the trunnion axis to the other side thereof, and iv. an arm on said trunnion extending outward of said frame for rotation of said trunnion through said range of angular positions from a first position, in which the connecting-rod axis is disposed on one side of the trunnion axis, to a second position, in which the connecting rod is disposed on the other side of the trunnion axis, the spring thereby applying torque to the trunnion in one direction when said arm is in the first position and in the opposite direction when said arm is in the second position, and B. said print carriage further comprising:

(1) means defining a printing anvil adjacent said path, and (2) means for rotatably mounting a printing band on said print carriage for cooperation with said anvil and said hammers when said print carriage is secured to said print frame to enable information to be printed on the recording medium.

2. A band-type data printer comprising a main frame releasably supporting a print carriage, A. said main frame being cooperable with said print carriage for defining a path for passage of a recording medium therebetween and containing a plurality of actuable hammers mounted adjacent said path and cooperable with said print carriage to imprint information on the recording medium, and further including:

(1) carriage supporting means for supporting said print carriage including i. first and second means on opposing sides of said recording medium path for receiving first and second mating means on the forward edge of said print carriage, and ii. third means for receiving a third mating means on the rear edge of said print carriage, (2) carriage latch means cooperable with said print carriage for releasably securing said print carriage to said frame, B. said print carriage further comprising:

(1) means defining a printing anvil adjacent said path, and (2) means for rotably mounting a printing band on said print carriage for cooperation with said anvil and said hammers when said print carriage is secured to said print frame to enable information to be printed on the recording medium.

3. A printer as defined in claim 1 in which each of said first and second receiving means comprises operator-adjustable threaded means threadably supported in said main frame, each of said first and second mating means abutting one of said first and second receiving means to facilitate adjustment of the width of said path so as to accommodate recording media of differing thicknesses.

4. A printer as defined in claim 3 wherein each of said first and second mating means comprises a pin extending forwardly of said anvil means.

5. A printer as defined in claim 3 in which said frame further includes first and second collars, each non-rotatably secured to one of said threaded means, linkage means extending between and pivotally coupled to both of said collars for simultaneously rotating both of said threaded means in unison to simultaneously advance or retract both of said threaded means in response to movement of said linkage means, and operator adjustment means connected to said linkage means for facilitating movement of said linkage means.

6. A printer as defined in claim 7 in which said frame is mounted on a pedestal having a forward side and a rearward side, with said path being disposed on the rearward side of said pedestal.

7. A printer as defined in claim 6 further comprising a medium receiving platform cantilever mounted on the rearward side of said pedestal for receiving the recording medium after it traverses through the printer.

8. A printer as defined in claim 2 further including a print ribbon supported in a cassette having pivotable guide arms defining the egress of said ribbon from said cassette and the ingress of said ribbon into said cassette, said print carriage further including first and second vertically extending members adjacent to and on opposite ends of said anvil means and providing bearing surfaces for contact with said pivotable arms and to thereby define the path of said ribbon.

* * * * *